US005701118A

United States Patent [19]

Hull et al.

[11] Patent Number: 5,701,118

[45] Date of Patent: Dec. 23, 1997

[54] BLOWN FUSE INDICATOR CIRCUIT AND FUSE CAP, INCLUDING A METHOD OF USE THEREFORE

[76] Inventors: Harold L. Hull, 401 Canyon Way #43, Sparks, Nev. 89434; Galen J. May; John J. May, both of 2245 Cielo Vista Dr., Reno, Nev. 89436

[21] Appl. No.: 603,544

[22] Filed: Feb. 20, 1996

[51] Int. Cl.[6] ..... G08B 21/00

[52] U.S. Cl. ..... 340/638; 340/691; 337/241; 337/266; 361/104; 324/507; 324/550

[58] Field of Search ..... 340/638, 639, 340/691, 693; 324/133, 507, 550; 337/241, 242, 245, 266; 335/17; 361/104

[56] References Cited

U.S. PATENT DOCUMENTS

| | | | |
|---|---|---|---|
| 3,218,413 | 11/1965 | Poehlman, Jr. | 337/197 |
| 3,457,535 | 7/1969 | Poehlman, Jr. | 337/242 |
| 4,056,816 | 11/1977 | Guim | 340/638 |
| 4,281,322 | 7/1981 | Nasu et al. | 340/638 |
| 4,499,447 | 2/1985 | Greenberg | 340/638 |
| 4,554,607 | 11/1985 | Mora | 340/638 |
| 4,652,867 | 3/1987 | Masot | 340/638 |
| 4,673,928 | 6/1987 | Guim | 340/638 |
| 4,691,197 | 9/1987 | Damiano et al. | 340/638 |
| 4,695,815 | 9/1987 | Hwang | 337/266 |
| 4,712,081 | 12/1987 | Bosley | 337/266 |
| 4,772,219 | 9/1988 | Falchetti | 340/638 |
| 4,815,993 | 3/1989 | Falchetti | 340/638 |
| 4,857,896 | 8/1989 | Brooks | 340/639 |
| 4,884,050 | 11/1989 | Kozel | 337/264 |
| 5,004,995 | 4/1991 | Lo | 337/266 |
| 5,300,913 | 4/1994 | Linton | 337/242 |
| 5,311,139 | 5/1994 | Fogal | 340/638 |
| 5,343,192 | 8/1994 | Yenisey | 340/638 |

*Primary Examiner*—Jeffery Hofsass
*Assistant Examiner*—Daniel J. Wu

[57] ABSTRACT

The present invention is substantially an indicator cap which is removably attachable to a prior art plug-in type fuse, and the cap having an indicator light for signaling that a fuse has blown so as to notify a user of the blown condition of the fuse. Furthermore, we provide unique circuitry which in combination with the existing circuitry provides unusual results, and we also provide a method of use therefore.

5 Claims, 1 Drawing Sheet

BLOWN FUSE INDICATOR CIRCUIT AND FUSE CAP, INCLUDING A METHOD OF USE THEREFORE

FIELD OF THE INVENTION

This invention particularly relates to blown fuse indicator means but more particularly to a device, and/or a wiring schematic which cooperates with a prior art fuse housing to illuminate an indicator light when a fuse has blown so as to notify the user thereof.

BACKGROUND OF THE INVENTION

It is well known within the field that when a fuse has blown, it can be quite time consuming and difficult to locate the fuse, especially under circumstances during the night, or in the dark where no exterior lighting is provided. This situation is more often encountered such as when one is within a vehicle and the fuse block/box is positioned within the glove box or under the dash. In such a situation it can be extremely difficult and irritating when one is searching for the blown fuse which must be replaced and they simply can't see the fuses and/or the fuses are not easily accessible.

It is therefore contended by the applicants that an efficient, easily installed blown fuse indicator cap, and/or a wiring arrangement which allows for illumination of an indicator light, and/or sound an alarm would be most advantageous and desirable and would eliminate guess work for the user as well as save time and wasted energy.

The above noted situation has been addressed within the prior art and attempts have been made to resolve the problems associated therewith, but most attempts prove to be much to costly and to complicated for the average user to install, and/or is simply inefficient.

The following are exempliary prior art references relating to blown fuse indicators such as found within the field of the present invention. U.S. Pat. No. 5,311,139 teaches a "FUSE CHECKER FOR TESTING INTEGRITY OF A MINIATURE, PLUG-IN FUSE WHILE THE FUSE IS INSTALLED IN AN ELECTRICAL CIRCUIT". This reference is functional for its intended purpose which is to "test" the condition of a fuse. The test is performed by using a checker which includes a housing from which extends a pair of parallel contact points adapted for engagement with terminal tabs that lie within terminal access openings within a plug-in type fuse housing and in practise, the user must manually insert the checker and apply constant pressure upon the terminal tabs while the test is performed and if a fuse is blown, one of two LED's located on the checker housing will illuminate, and if the fuse is not blown, both LED's on the checker will illuminate. This checker device is not designed to be used and/or installed on a permanent basis and is only usable for performing the above described test. This reference is therefore limited in use and could not be installed on a permanent basis as can the present invention.

Various types of spring clips have been taught for securing a blown fuse light indicator to a cartridge fuse as indicated by U.S. Pat. Nos. 3,432,789 and 3,457,535. However, these references have addressed only cartridge type fuse holders and each would not be attachable or functional if used on a plug-in type fuse. It is common knowledge that in many cases, the plug-in type fuse has become the fuse housing of choice, such as found within most fuse boxes used within most modern day vehicles. Therefore, it is contended by the applicants that a need exists for substantially a fuse cap which may be removably attached to an existing plug-in type fuse housing and circuitry is provided which will allow an LED located on the fuse cap, (and/or a sound alarm) to indicate that the fuse attached thereto has blown.

SUMMARY OF THE INVENTION

The present invention is substantially a blown fuse indicator cap which is removably attachable to an existing plug-in type fuse housing while the fuse housing is engaged within an electrical circuit, such as a circuit which is commonly found within most vehicle fuse block/boxes with the circuit being energized by a power source, such as a battery. The blown fuse indicator cap includes thereon an indicator light, and/or a sound alarm, and further provides appropriate circuitry for illuminating the light, and/or for causing a buzzer to sound an alarm.

It is therefore a primary object of the present invention to provide a blown fuse indicator cap which is removably attachable to an existing prior art plug-in type fuse housing when the fuse is installed in an electrical circuit.

It is another object of the present invention to provide a blown fuse indicator cap which includes means thereon for indicating when the fuse attached thereto has blown. Such as the cap may include a light source such as an indicator light, or the cap may include a sound alarm such as a buzzer, and/or the cap may include a combination of each.

It is another important object of the present invention to provide a blown fuse indicator cap which may be produced in a variety of colors which correspond to the various types of colored fuse housings, with the color of each representing and indicating amperage thereof.

Still another object of the present invention is to provide a blown fuse indicator cap which includes appropriate circuitry for causing the unusual results of having an indicator light, and/or buzzer to be activated when the fuse has blown.

Yet another object of the present invention is to provide a blown fuse indicator cap which includes means to removably retain the cap when attached to a plug-in type fuse housing.

A further object of the present invention is to provide a blown fuse indicator cap having means therein to forcibly direct the extending parallel contact points within the cap against the terminal tabs that lie within terminal access openings in the fuse housing.

Yet another object of the present invention is to provide a method for installing a blown fuse indicator and instructions for use therefor.

Other objects and advantages will be seen when taken into consideration with the following drawings and specification.

DETAILED DESCRIPTION OF THE DRAWINGS

Figure 1:
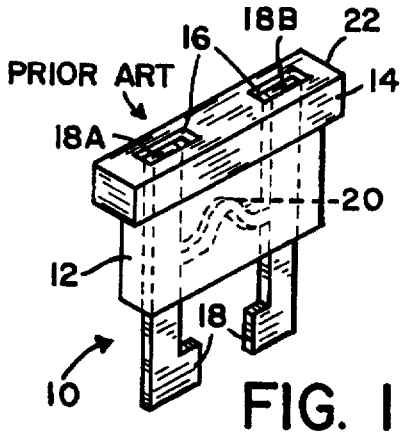
FIG. 1 is substantially a perspective view of a prior art miniature, plug-in type fuse.

Referring now in detail to the drawings wherein like numerals represent like elements throughout the various views, in FIG. 1, arrow (10) is substantially an overview of a typical prior art miniature plug-in type fuse as commonly found within most vehicle electrical circuits. (12) is a fuse housing for containing fuse (10) with the housing (12) being of colored plastic material, with the color being indicative of the current rating of the fuse so as to signify amperage, and includes a generally rectangular top wall (14) that has a pair of longitudinally spaced terminal access openings (16) that extend through top wall (14) to the interior of fuse housing (12).

Positioned within housing (12) and extending from the opposite end of housing (12) from top wall (14) are a pair of parallel, spaced, blade-type fuse terminals (18) that are adapted to be received within a correspondingly spaced pair of fuse receptacle contacts within a plastic fuse block, or the like (not shown). Fuse terminals (18) have a length sufficient for them to extend outwardly from the lower end of housing (12), and also to extend into housing (12) to be received and tightly held by the housing by suitable terminal anchoring arrangements (not shown). Extending between each of fuse terminals (18) within fuse housing (12) is a fusible link (20) that has a size and that is made from a material that permits the passage between fuse terminals (18) of currents less than the rated current value of the fuse, and that will melt or separate if a current greater than the rated current value of the fuse passes through the fusible link.

The prior art fuse (10) when installed within an electrical circuit allows the fuse housing (12) to be partially exposed and the top wall (14) provides substantially a protruding attachment portion (22) and the fuse (10) when installed within an electrical circuit has a first and a second exposed terminal tab, (18A) & (18B) that lie within terminal access openings (16) within the fuse housing (12).

Figure 2:
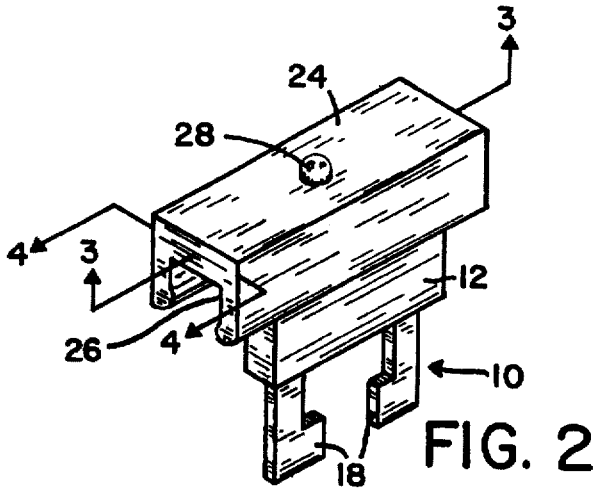
FIG. 2 is substantially a perspective view of an indicator cap when attached to a prior art miniature, plug-in type fuse.

Referring now to FIG. 2 wherein we show a blown fuse indicator cap (24) which is removably attachable to the above described prior art plug-in type fuse housing (12) by any suitable attachment means of engineering choice, such as the indicator cap (24) including a housing which is of a shape and size to removably capture and mate with the attachment portion (22), representive thereof and as shown in the preferred embodiment with the housing (12) having an elongated recess 26 which is of a shape and size to frictionally receive the attachment portion (22) therein and therefore retains the fuse housing (12) in a secure manner. It is to be noted that the cap (24) can be made from any suitable material of engineering choice, however, the applicants have found that if the cap (24) is made from the same material as the fuse housing (12), such as injection molded thermoplastic material like polystyrene, then both the fuse housing (12) and the cap (24) can be made from colored plastic material and the color being indicative of the current rating of the fuse (10) and the cap (24).

The cap (24) comprising substantially of; housing (24) and an indicator light (28), with the light (28) being attached at a location of engineering choice to the cap (24) and therefore is considered a part thereof.

Figure 3:
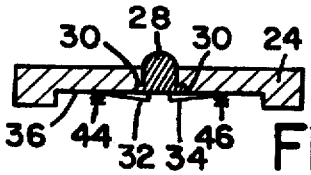
FIG. 3 is substantially a sectional view of the indicator cap taken at 3—3 of FIG. 2.
Figure 4:
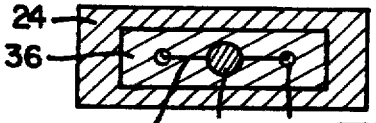
FIG. 4 is substantially a sectional view of the indicator cap taken at 4—4 of FIG. 2.

Referring now to FIGS. 3 & 4, we show the preferred embodiment for attaching the indicator light (28) to the cap (24), wherein we provide an indent (30) within the cap housing (24) which is of a shape and size to frictionally receive and retain the light (28) therein with the light (28) having a first and a second lead (32) & (34) extending therefrom, with the cap housing (24) having means for receiving and retaining the first and second lead (32) & (34) therein, and any suitable means of engineering choice may be used for retaining the light (28) and/or the leads (32) & (34) within the cap (24), however, the preferred embodiment as shown in FIGS. 3 & 4, proves to be most successful, wherein we provide a cavity (36) for receiving and retaining the first and the second lead (32) & (34) therein.

It will now be seen that when the cap (24) is attached to the fuse housing (12), the first terminal tab (18A) and the first lead (32) are aligned in communication and the second terminal tab (18B) and the second lead (34) are aligned in communication. It is to be noted that we further provide means for the tabs (18A) & (18B) to have a biased relationship with the leads (32) & (34) so as provide a complete continuous contact therefore, such as the first lead being coiled at the point of communication, see numeral (44), and the second lead being coiled at the point of communication, see numeral (46).

Figure 5:
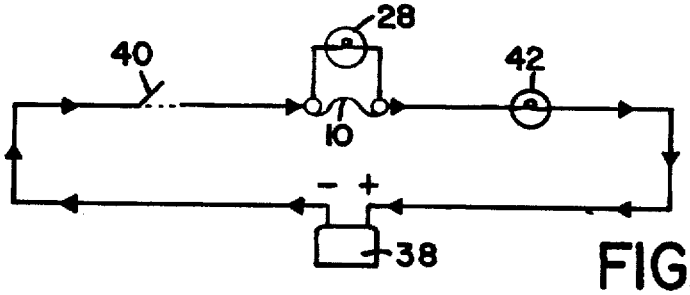
FIG. 5 is a schematic showing a complete circuit when the fuse is operational.
Figure 6:
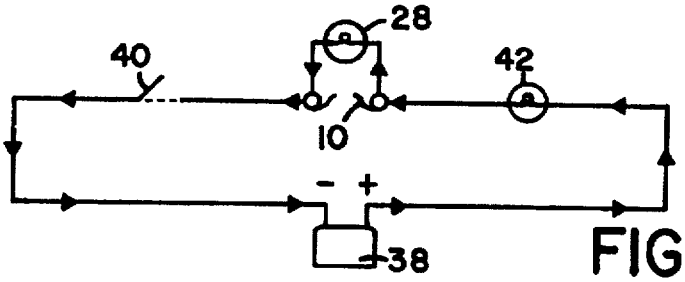
FIG. 6 is a schematic showing a complete circuit when the fuse has blown.

Referring now to FIGS. 5 & 6, wherein we have shown schematics which depict an electrical circuit comprising in combination; a power supply source (38), a switch of engineering choice such as a light switch (40) which has an open and a closed position, fuse (10), a load (42) and the indicator light (28) being connected in parallel across the fuse (10).

It will now be seen that when the power source (38) energizes the circuit, the current will flow in the direction of the arrows as depicted within FIG. 5, which directs the current toward switch (40), and when switch (40) is activated into its open position (depicted by ghost lines), the current is then directed to fuse (10) which in turn energizes load (42) (depicted as a light) and the circuit is complete and the indicator light (28) does not illuminate. However, when the fuse (10) blows, (as depicted in FIG. 6) and the power source (38) energizes the circuit, the current will flow in the direction of the arrows through the load (42), through the indicator light (28) which is now illuminated, through the switch (40) which is in a closed position and then completes the circuit.

It is to be further noted that the present invention can be installed after market by the consumer and attached to substantially any plug-in type fuse of choice, or the unique combination as taught within the present invention (namely the fuse (10) and the cap (24) may be integrally formed at the point of manufacture.

It is to be further noted that we herein provide a method for using and installing a blown fuse indicator cap (24) which is attachable to a plug-in type fuse housing (12), with the fuse housing containing a fuse (10) which is installed within an electrical circuit, with the electrical circuit comprising in combination; a power supply source (38), a switch (40), fuse (10), a load (42) and an indicator light (28) connected in parallel across the fuse (10) with the light (28) being a part of the cap (24), with the method including the steps of;

a. locating the fuse housing;

b. locating the cap; and c. attaching the cap to the fuse housing; whereby;

when the fuse is operational, the light will not illuminate, and when the fuse has blown, the light will illuminate and notify the user of the blown condition of the fuse.

It will now be seen that we have herein provided a blown fuse indicator cap which is removably attached to an existing prior art plug-in type fuse housing when the fuse is installed in an electrical circuit.

It will further be seen that we have herein provided a blown fuse indicator cap which can be integrally formed with the fuse at the point of manufacture.

It will also be seen that we have herein provided a blown fuse indicator cap which can be manufactured in a variety of colors which correspond to the various types of colored fuse housings, with the color of each representing and indicating amperage thereof.

Although the invention has been shown and described in what is conceived to be the most practical and preferred embodiment it is recognized that departures may be made therefrom within the scope and spirit of the invention, which is not to be limited to the details disclosed herein but is to be accorded the full scope of the claims so as to embrace any and all equivalent devices and or apparatuses.

Having described our invention, what we claim as new and desire to secure by Letters Patent is:

1. A blown fuse indicator cap which is removably attachable to a pre-existing plug-in type fuse housing, said cap comprising; a cap housing which is of a shape and size to removably capture and mate with said plug-in type fuse housing, an indicator light having a first and a second lead extending therefrom, and said cap housing having means for receiving and retaining said first and said second lead there through.

2. The indicator cap housing of claim 1 wherein said means for receiving and retaining said first and said second lead there through is a cavity formed within said cap housing, thus said first and said second lead each provide an exposed end within said cavity and each said exposed end protrudes therefrom.

3. The indicator cap housing of claim 2 wherein each said exposed end is coiled.

4. A blown fuse indicator cap comprising; a cap housing having an elongated integrally formed recess, said recess being of a shape and size to frictionally removably receive therein a portion of a pre-existing plug-in type fuse housing, said cap housing having an indent which is of a shape and size to frictionally receive and retain an indicator light, said indicator light having a first and a second lead extending therefrom into a cavity which is integrally formed within said cap housing, said first and said second lead each being exposed and protruding from within said cavity, and said first and said second lead each being coiled where exposed.

5. A method for using and installing a blown fuse indicator cap which is attachable to a pre-existing plug-in type fuse housing, said fuse housing containing a fuse which is installed within an electric circuit, said circuit comprising in combination; a power supply source, a switch, said fuse, a load and an indicator light connected in parallel across said fuse with said light being a part of said cap, said method including the following steps of;

a. locating said fuse housing;

b. locating said cap; and c. attaching said cap to said fuse housing; whereby;

when said fuse is operational, said light will not illuminate, and when said fuse has blown, said light will illuminate and notify the user of the blown condition of said fuse.

* * * * *